US006244286B1

(12) United States Patent
Russo

(10) Patent No.: US 6,244,286 B1
(45) Date of Patent: Jun. 12, 2001

(54) COLLAPSIBLE CANOPY DEVICE

(76) Inventor: Aleandro M. Russo, 1407 Trotwood Avenue, Mississauga, Ontario (CA), L5G 3Z7

( * ) Notice: Subject to any disclaimer, the term of this patent is extended or adjusted under 35 U.S.C. 154(b) by 0 days.

(21) Appl. No.: 09/470,761

(22) Filed: Dec. 23, 1999

(51) Int. Cl.[7] ..... A47C 7/62; E04H 15/02; E04H 15/36

(52) U.S. Cl. ..... 135/128; 135/124; 135/141; 135/161; 135/87; 135/96; 135/900; 297/184.11; 297/184.15

(58) Field of Search ..... 135/87, 96, 124, 135/128, 141, 161, 900; 52/3, 6; 297/184.1, 184.11, 184.15, 184.17

(56) References Cited

U.S. PATENT DOCUMENTS

| | | | |
|---|---|---|---|
| D. 335,046 | | 4/1993 | Diaz . |
| 1,214,979 | * | 2/1917 | Von Ahnen . |
| 2,357,056 | * | 8/1944 | Nelson . |
| 2,836,187 | * | 5/1958 | Dunnagan . |
| 2,851,045 | | 9/1958 | Haselton . |
| 3,052,251 | * | 9/1962 | De Jean, Jr. . |
| 3,383,127 | * | 5/1968 | Grunfeld . |
| 3,417,764 | * | 12/1968 | Hemenway . |
| 3,858,643 | | 1/1975 | Reed et al. . |
| 4,086,931 | | 5/1978 | Hall . |
| 4,781,411 | | 11/1988 | Kolb . |
| 5,096,257 | * | 3/1992 | Clark . |
| 5,203,363 | | 4/1993 | Kidwell et al. . |
| 5,253,667 | * | 10/1993 | Chung . |
| 5,441,067 | * | 8/1995 | James et al. . |
| 5,564,452 | * | 10/1996 | Kitchen . |

* cited by examiner

*Primary Examiner*—Robert Canfield

(57) ABSTRACT

A collapsible canopy device for attaching to a bleacher-type seat. The collapsible canopy device includes a pair of support arms, each having end portions with an attachment structure. At least one spanning arm has a pair of ends adapted to removably couple to the attachment structures. A pair of securing means secure the support arms to a bench. Each of the securing means has a base portion, a first elongate member and second elongate member. Each of the elongate members has a first end and a second end. The first end of the elongate members is integrally coupled to the base portion of the securing means to form a generally U-shaped configuration. Each of the second ends of the first elongate members is fixedly coupled to an end of the support arms. A panel hangs on each of the support arms and spanning arm.

20 Claims, 2 Drawing Sheets

FIG 1
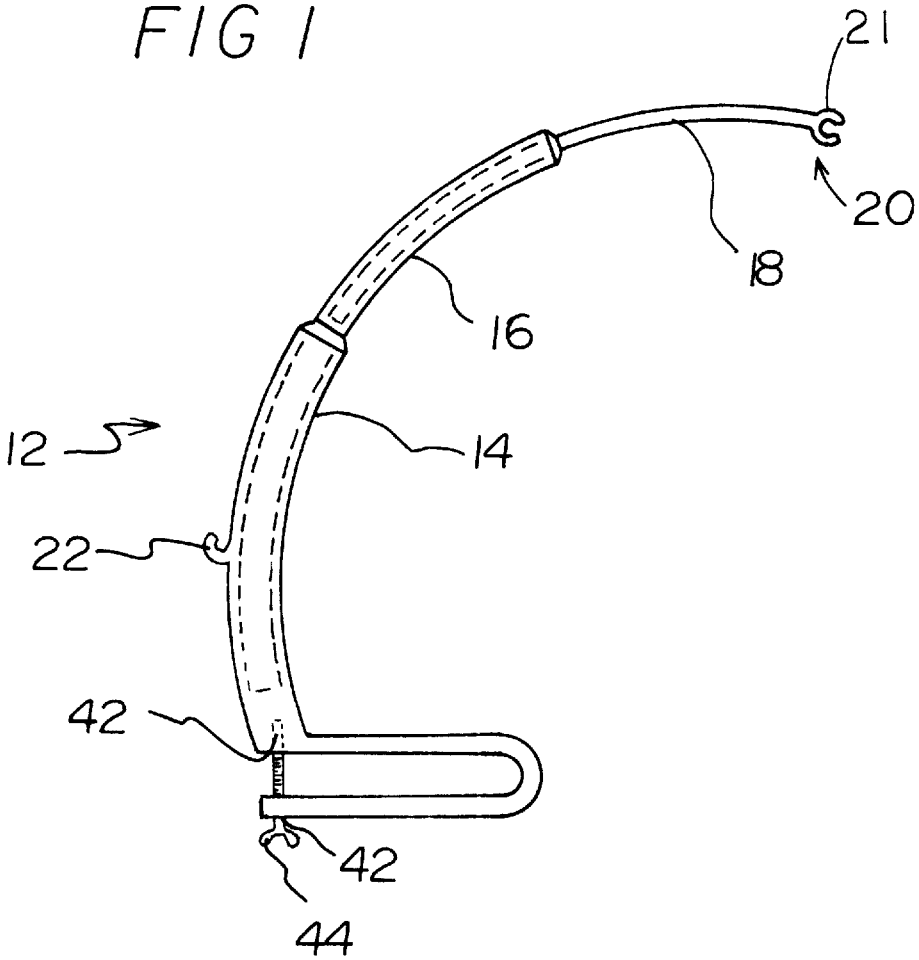
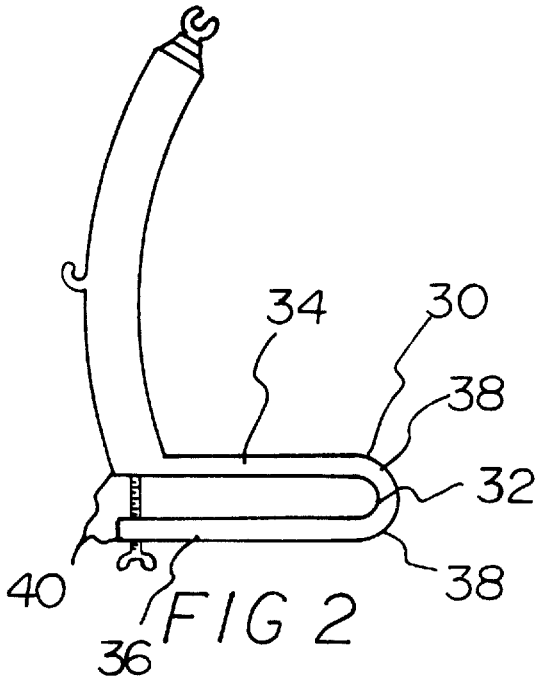
FIG 2
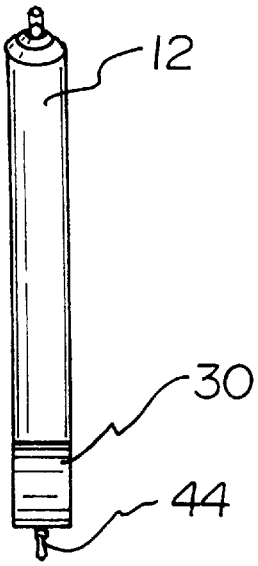
FIG 3

FIG 4
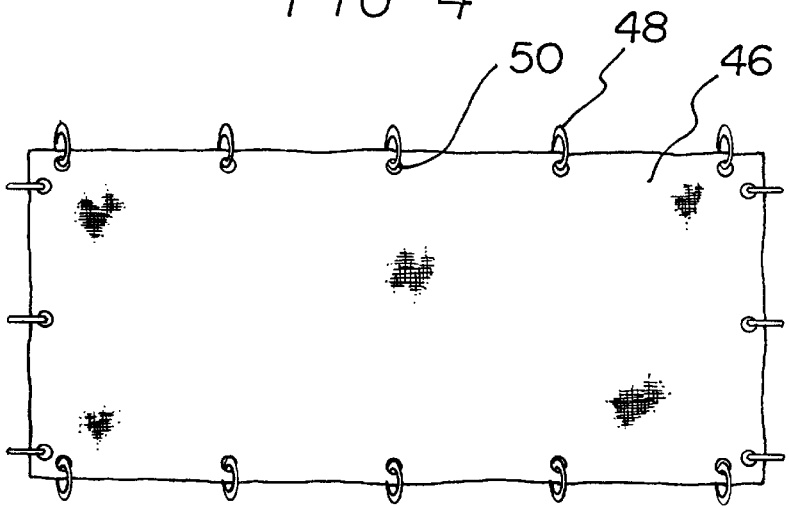
FIG 5
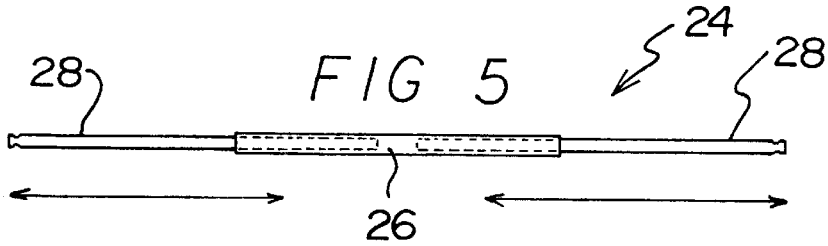
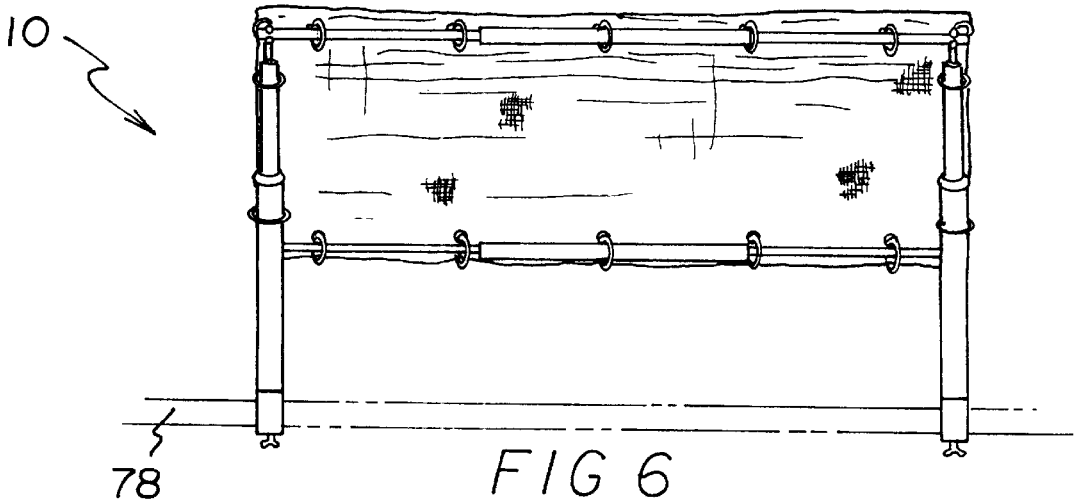
FIG 6

COLLAPSIBLE CANOPY DEVICE

BACKGROUND OF THE INVENTION

1. Field of the Invention

The present invention relates to canopy devices and more particularly pertains to a new collapsible canopy device for attaching to a bleacher-type seat.

2. Description of the Prior Art

The use of canopy devices is known in the prior art. More specifically, canopy devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,086,931; 3,858,643; 5,203,363; 4,781,411; 2,851,045; and U.S. Des. Pat. No. 335,046.

While these devices fulfill their respective, particular objectives and requirements, the aforementioned patents do not disclose a new collapsible canopy device. The inventive device includes a pair of support arms, each having end portions with an attachment structure. At least one spanning arm has a pair of ends adapted to removably couple to the attachment structures. A pair of securing means secure the support arms to a bench. Each of the securing means has a base portion, a first elongate member and second elongate member. Each of the elongate members has a first end and a second end. The first end of the elongate members is integrally coupled to the base portion of the securing means to form a generally U-shaped configuration. Each of the second ends of the first elongate members is fixedly coupled to an end of the support arms. A panel hangs on each of the support arms and spanning arm.

In these respects, the collapsible canopy device according to the present invention substantially departs from the conventional concepts and designs of the prior art, and in so doing provides an apparatus primarily developed for the purpose of attaching to a bleacher-type seat.

SUMMARY OF THE INVENTION

In view of the foregoing disadvantages inherent in the known types of canopy devices now present in the prior art, the present invention provides a new collapsible canopy device construction wherein the same can be utilized for attaching to a bleacher-type seat.

The general purpose of the present invention, which will be described subsequently in greater detail, is to provide a new collapsible canopy device apparatus and method which has many of the advantages of the canopy devices mentioned heretofore and many novel features that result in a new collapsible canopy device which is not anticipated, rendered obvious, suggested, or even implied by any of the prior art canopy devices, either alone or in any combination thereof.

To attain this, the present invention generally comprises a pair of support arms, each having end portions with an attachment structure. At least one spanning arm has a pair of ends adapted to removably couple to the attachment structures. A pair of securing means secure the support arms to a bench. Each of the securing means has a base portion, a first elongate member and second elongate member. Each of the elongate members has a first end and a second end. The first end of the elongate members is integrally coupled to the base portion of the securing means to form a generally U-shaped configuration. Each of the second ends of the first elongate members is fixedly coupled to an end of the support arms. A panel hangs on each of the support arms and spanning arm There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible canopy device apparatus and method which has many of the advantages of the canopy devices mentioned heretofore and many novel features that result in a new collapsible canopy device which is not anticipated, rendered obvious, suggested, or even implied by any of the prior art canopy devices, either alone or in any combination thereof.

It is another object of the present invention to provide a new collapsible canopy device which may be easily and efficiently manufactured and marketed.

It is a further object of the present invention to provide a new collapsible canopy device which is of a durable and reliable construction.

An even further object of the present invention is to provide a new collapsible canopy device which is susceptible of a low cost of manufacture with regard to both materials and labor, and which accordingly is then susceptible of low prices of sale to the consuming public, thereby making such collapsible canopy device economically available to the buying public.

Still yet another object of the present invention is to provide a new collapsible canopy device which provides in the apparatuses and methods of the prior art some of the advantages thereof, while simultaneously overcoming some of the disadvantages normally associated therewith.

Still another object of the present invention is to provide a new collapsible canopy device for attaching to a bleacher-type seat.

Yet another object of the present invention is to provide a new collapsible canopy device which includes a pair of support arms, each having end portions with an attachment structure. At least one spanning arm has a pair of ends adapted to removably couple to the attachment structures. A pair of securing means secure the support arms to a bench. Each of the securing means has a base portion, a first elongate member and second elongate member. Each of the elongate members has a first end and a second end. The first end of the elongate members is integrally coupled to the base portion of the securing means to form a generally U-shaped configuration. Each of the second ends of the first elongate members is fixedly coupled to an end of the support arms. A panel hangs on each of the support arms and spanning arm.

Still yet another object of the present invention is to provide a new collapsible canopy device that has collapsible support arms for easy and convenient storage.

Even still another object of the present invention is to provide a new collapsible canopy device that attaches to the seat portion of a bleacher and extends over the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic side view of the extended support arm of a new collapsible canopy device according to the present invention.

FIG. 2 is a schematic side view of the collapsed support arm of the present invention.

FIG. 3 is a schematic front view of the present invention.

FIG. 4 is a schematic plan view of the panel of the present invention.

FIG. 5 is a schematic front view of the spanning arm of the present invention.

FIG. 6 is a schematic front view of the present invention.

DESCRIPTION OF THE PREFERRED EMBODIMENT

With reference now to the drawings, and in particular to FIGS. 1 through 6 thereof, a new collapsible canopy device embodying the principles and concepts of the present invention and generally designated by the reference numeral 10 will be described.

As best illustrated in FIGS. 1 through 6, the collapsible canopy device 10 generally comprises a pair of support arms 12. Each of the support arms is telescopic. The support arms each have a base section 14, a middle section 16 and a top section 18. Each of the top sections 18 has an end portion 20. The end portions 20 have an attachment structure comprising two spaced fingers 21 having a parallel orientation. The top section 18 is slidably insertable into the middle section 16 and the middle section 16 is slidably insertable into the base section 14. Each of the sections of the support arms 12 is arcuate.

One of a pair of hooks 22 is each integrally coupled to one of the base sections 14 of the support arms 12. Each of the hooks 22 has a hook portion is directed toward the top section 18 of the support arms 12.

Both of a pair of spanning arms 24 are collapsible in length. Each of the spanning arms 24 comprises a middle portion 26 and two elongate members 28. Each of the elongate members 28 is slidably insertable into the middle portion 26 such that a length of the spanning arms 24 may be adjusted. The elongate members 28 have a generally circular shaped cross-section taken perpendicular to a longitudinal axis of the elongate members, and a diameter adapted to fit between the fingers 21 of support arms 12 and in the hooks 22. The ends of the elongate members 28 may be notched to aid in securing them in the fingers and hooks.

A pair of securing means 30 secure the base sections 14 to the bench 78. Each of the securing means 30 has a base portion 32, a first elongate member 34 and second elongate member 36. Each of the elongate members has a first end 38 and a second end 40. The first end 38 of the first 34 and second 36 elongate members is integrally coupled to the base portion 32 of the securing means 30 to form a generally U-shaped configuration. The second ends 40 of the first elongate members 34 are fixedly coupled to an end of the base sections 14 of the support arms 12. Each of the second ends 40 of the first 34 and the second 36 elongate members has a bore 42 therethrough. The bores 42 in each of the first elongate members 34 are generally coaxial with the bores in each of the second elongate members 36.

A pair of fastening means 44 releasably fasten the securing means 30 on the bench 78. Each of the fastening means 44 extending through the bores 42 in the first 34 and second 36 elongate members. Each of the fastening means 44 comprises a screw.

A panel 46 for hanging on each of the support arms 12 and spanning arms 24 has four edges. Each of the edges has a plurality of hanging devices 48 thereon. Each of the hanging devices 48 is a ring preferably fixed to a grommet 50 formed in the panel. Each of the rings 48 has a diameter greater than a diameter of the support arms 12 and the spanning arms 24. The panel 46 has generally rectangular shape. The panel 46 is formed from cloth. The cloth is preferably made from cotton, wool, silk or synthetic fibers.

In use, the rings 48 on the panel 46 are placed over spanning arms and the support arms. One of the spanning arms 24 are placed on the hooks 22 and the other of the spanning arms 24 are placed in the fingers 20 attached to the end of the support arms 12 such that the panel 46 is suspended on the arms.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible canopy device for removably attaching to a bench portion of a bleacher-type seat, said device comprising:

a pair of support arms, each of said support arms having end portions having an attachment structure;

at least one spanning arm, each of said spanning arms having a pair of ends adapted to removably coupled to said attachment structures;

a pair of securing means, each securing means being for securing one of said support arms to the bench, each of said securing means having a base portion, a first elongate member and second elongate member, each of said elongate members having a first end and a second end, said first end of said elongate members being integrally coupled to said base portion of said securing means to form a generally U-shaped configuration, each of said second ends of said first elongate members being fixedly coupled to an end of said support arms;

a panel for hanging on each of said support arms and spanning arm; and each of said support arms being arcuate.

2. The collapsible canopy device as in claim 1, wherein said spanning arm comprises:

said spanning arm being collapsible in length, said spanning arm comprising a middle portion and two elongate members, said elongate members being slidably insertable into said middle portion such that a length of said spanning arm may be adjusted.

3. The collapsible canopy device as in claim 2, wherein each of said support arms comprise:

each of said support arms being telescopic, each of said support arms comprising a base section, a middle section and a top section, each of said top sections having an end portion, each of said end portions having said attachment structure; and wherein each of said securing means is each fixedly coupled to one of said base sections of said support arms.

4. The collapsible canopy device as in claim 3, wherein said support arms comprise:

each of said attachment structures comprising two spaced fingers having a parallel orientation, each of said sections of said support arms being generally arcuate.

5. The collapsible canopy device as in claim 4, further comprising:

a pair of hooks, each of said hooks being integrally coupled to one of said base sections of said support arms, each of said hooks having a hook portion being directed toward said top section of said support arms.

6. The collapsible canopy device as in claim 5, further comprising:

each of said second ends of said first and said second elongate members having a bore therethrough, said bores in each of said first elongate members being generally coaxial with said bores in each of said second elongate members; and a pair of fastening means for releasably fastening said securing means on said bench, each of said fastening means extending through said bores in said first and second elongate members, each of said fastening means comprising a screw.

7. The collapsible canopy device as in claim 5, wherein said spanning arm comprises:

a pair of spanning arms, each of said spanning arms being collapsible in length, each of said spanning arms comprising a middle portion and two elongate members, each of said elongate members being slidably insertable into said middle portion such that a length of said spanning arms may be adjusted.

8. The collapsible canopy device as in claim 7, wherein said spanning arms comprise:

each of said elongate members having a generally circular shaped cross-section taken perpendicular to a longitudinal axis of said elongate members, said elongate members having a diameter adapted to fit between said fingers of support arms and in said hooks.

9. The collapsible canopy device as in claim 5, wherein said panel comprises:

said panel having a plurality of edges, each of said edges having a plurality of hanging devices thereon.

10. The collapsible canopy device as in claim 9, wherein said panel comprises:

each of said hanging devices being a ring fixed to a grommet formed in said panel, each of said rings having a diameter greater than a diameter of said support arms and said spanning arms.

11. The collapsible canopy device as in claim 10, wherein said panel comprises:

said panel having four edges, said panel having generally rectangular shape.

12. The collapsible canopy device as in claim 11, wherein panel comprises:

said panel being formed from cloth, said cloth being cotton.

13. A collapsible canopy device for removably attaching to a bench portion of a bleacher-type seat, said device comprising:

a pair of support arms, each of said support arms having end portions having an attachment structure;

at least one spanning arm, each of said spanning arms having a pair of ends adapted to removably coupled to said attachment structures;

a pair of securing means, each securing means being for securing one of said support arms to the bench, each of said securing means having a base portion, a first elongate member and second elongate member, each of said elongate members having a first end and a second end, said first end of said elongate members being integrally coupled to said base portion of said securing means to form a generally U-shaped configuration, each of said second ends of said first elongate members being fixedly coupled to an end of said support arms;

a panel for hanging on each of said support arms and spanning arm;

each of said support arms being telescopic, each of said support arms comprising a base section, a middle section and a top section, each of said top sections having an end portion, each of said end portions having said attachment structure; and wherein each of said securing means is each fixedly coupled to one of said base sections of said support arms.

14. The collapsible canopy device as in claim 13, wherein said support arms comprise:

each of said attachment structures comprising two spaced fingers having a parallel orientation, each of said sections of said support arms being generally arcuate.

15. The collapsible canopy device as in claim 14, wherein said spanning arm comprises:

a pair of spanning arms, each of said spanning arms being collapsible in length, each of said spanning arms comprising a middle portion and two elongate members, each of said elongate members being slidably insertable into said middle portion such that a length of said spanning arms may be adjusted.

16. The collapsible canopy device as in claim 15, wherein said spanning arms comprise:

each of said elongate members having a generally circular shaped cross-section taken perpendicular to a longitudinal axis of said elongate members, said elongate members having a diameter adapted to fit between said fingers of support arms and in said hooks.

17. The collapsible canopy device as in claim 14, further comprising:

a pair of hooks, each of said hooks being integrally coupled to one of said base sections of said support arms, each of said hooks having a hook portion being directed toward said top section of said support arms.

18. The collapsible canopy device as in claim 17, further comprising:

each of said second ends of said first and said second elongate members having a bore therethrough, said bores in each of said first elongate members being generally coaxial with said bores in each of said second elongate members; and a pair of fastening means for releasably fastening said securing means on said bench, each of said fastening means extending through said bores in said first and second elongate members, each of said fastening means comprising a screw.

19. The collapsible canopy device as in claim 17, wherein said panel comprises:

said panel having a plurality of edges, each of said edges having a plurality of hanging devices thereon.

20. A collapsible canopy device for removably attaching to a bench portion of a bleacher-type seat, said device comprising:

a pair of support arms, each of said support arms having end portions having an attachment structure;

at least one spanning arm, each of said spanning arms having a pair of ends adapted to removably coupled to said attachment structures;

a pair of securing means, each securing means being for securing one of said support arms to the bench, each of said securing means having a base portion, a first elongate member and second elongate member, each of said elongate members having a first end and a second end, said first end of said elongate members being integrally coupled to said base portion of said securing means to form a generally U-shaped configuration, each of said second ends of said first elongate members being fixedly coupled to an end of said support arms;

a panel for hanging on each of said support arms and spanning arm; and said spanning arm being collapsible in length, said spanning arm comprising a middle portion and two elongate members, said elongate members being slidably insertable into said middle portion such that a length of said spanning arm may be adjusted.

* * * * *